US006611797B1

(12) United States Patent
Amada et al.

(10) Patent No.: US 6,611,797 B1
(45) Date of Patent: Aug. 26, 2003

(54) SPEECH CODING/DECODING METHOD AND APPARATUS

(75) Inventors: Tadashi Amada, Kobe (JP); Katsumi Tsuchiya, Kobe (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/488,748

(22) Filed: Jan. 21, 2000

(30) Foreign Application Priority Data

Jan. 22, 1999 (JP) ..... 11-014455

(51) Int. Cl.[7] ..... G10L 19/10; G10L 19/12
(52) U.S. Cl. ..... 704/211; 704/220; 704/223
(58) Field of Search ..... 704/219, 220, 704/221, 222, 223, 211, 212

(56) References Cited

U.S. PATENT DOCUMENTS 3,789,144 A * 1/1974 Doyle ..... 704/201
5,027,405 A * 6/1991 Ozawa ..... 704/223
5,060,268 A * 10/1991 Asakawa et al. ..... 704/211
5,142,584 A * 8/1992 Ozawa ..... 704/219
5,991,717 A * 11/1999 Minde et al. ..... 704/223
6,385,574 B1 * 5/2002 Benno ..... 704/221
6,385,576 B2 * 5/2002 Amada et al. ..... 704/219
6,393,391 B1 * 5/2002 Ozawa ..... 704/219

* cited by examiner

*Primary Examiner*—Marsha D. Banks-Harold
*Assistant Examiner*—Martin Lerner
(74) *Attorney, Agent, or Firm*—Oblon, Spivak, McClelland, Maier & Neustadt, P.C.

(57) ABSTRACT

An input speech signal to an input terminal is supplied to a speech synthesizer section through a speech analyzer section and frequency parameter quantizer section to form a synthesis filter, and the input speech signal is expressed by quantized LPC coefficients representing the characteristics of the synthesis filter and an excitation signal for exciting the synthesis filter. In this case, in a pulse excitation section, a pulse position selector selects pulse position candidates from the integer pulse positions and non-integer pulse positions stored in a pulse position codebook, and an integer position pulse generator and non-integer position pulse generator respectively generate integer position pulses set at sampling points of the excitation signal and non-integer position pulses set at positions located between sampling points. These pulses are synthesized into a pulse train serving as a source of an excitation signal.

20 Claims, 7 Drawing Sheets

SPEECH CODING/DECODING METHOD AND APPARATUS

BACKGROUND OF THE INVENTION

The present invention relates to a low rate speech coding/decoding method used for digital telephones, voice memories, and the like.

Recently, as a coding technology used for portable telephones, the internet, and the like to compress speech information and audio information to small information amounts and transmit or store them, the CELP (Code Excited Linear Prediction (M. R. Schroeder and B. S. Atal, "Code Excited Linear Prediction (CELP): High Quality Speech at Very Low Bit Rates," Proc. ICASSP, pp. 937–940, 1985 (reference 1)) scheme has been often used.

The CELP scheme is a coding scheme based on linear predictive analysis, in which an input speech signal is separated into linear predictive coefficients representing phoneme information and a prediction residual signal representing characteristics such as pitch period of a speech by linear predictive analysis. A digital filter, called a synthesis filter, is formed on the basis of the linear predictive coefficients. The original input speech signal can be reconstructed by inputting the prediction residual signal as an excitation signal to the synthesis filter. For low-bit-rate speech coding, these linear predictive coefficients and the prediction residual signal must be coded with a small number of bits.

In the CELP scheme, a signal obtained by coding a prediction residual signal is generated as an excitation signal by adding the products of two types of vectors, i.e., a pitch vector and a stochastic vector, and gains.

A stochastic vector is generally generated by searching for an optimal candidate from a codebook in which many candidates are stored. This search uses a method of generating synthesized speech signals by filtering all the stochastic vectors through the synthesis filter together with pitch vectors, and selecting a stochastic vector with which a synthesized speech signal, such that an error between the synthesized speech signal and the input speech signal is minimum, is generated. It is therefore an important point for the CELP scheme to efficiently store stochastic vectors in the codebook.

As a scheme for satisfying such a requirement, pulse excitation, expressing a stochastic vector by a train of several pulses, is known. An example of this scheme is the multi-pulse scheme disclosed in reference 2 (K. Ozawa and T. Araseki, "Low Bit Rate Multi-pulse Speech Coder with Natural Speech Quality," IEEE Proc. ICASSP '86, pp. 457–460, 1986).

An Algebraic codebook (J-P. Adoul et al, "Fast CELP coding based on algebraic codes", Proc. ICASSP '87, pp. 1957–1960 (reference 3) is another example and has a simple structure in which a stochastic vector is expressed by only the presence/absence of a pulse and polarity (+, −). In spite of the limitation that the amplitude of a pulse is 1, unlike a multi-pulse, this technique is widely used for low rate coding because speech quality does not deteriorate much and a fast search method is proposed. As a scheme using an algebraic codebook, an improved scheme of allowing a pulse to have an amplitude has been proposed as disclosed in reference 4 (Chang Deyuan, "An 8 kb/s low complexity CELP speech codec," 1996 3rd International Conference on Signal Processing, pp. 671–4, 1996).

In each type of pulse excitation described above, pulse position candidates at which pulses are set are limited to integer sampling positions, i.e., sampling points of a stochastic vector. For this reason, even if an attempt is made to improve the performance of a stochastic vector by increasing the number of bits assigned to pulse position candidates, bits cannot be assigned beyond the number of bits required to express the number of samples contained in a frame.

Even in a case wherein adapting of pulse position candidates which is provided by U.S. patent application Ser. No. 09/220,062 is to be performed, if the number of bits expressing position information is large, pulse position candidates are set for most samples even at a section where pulse position candidates should be dispersed. As a consequence, this section is difficult to discriminate from a section on which pulse position candidates are concentrated, resulting in a poor adapting effect.

BRIEF SUMMARY OF THE INVENTION

It is an object of the present invention to provide a speech coding/decoding method that can assign an arbitrary number of bits to pulse position information, regardless of the number of samples in a frame, which is a length of an excitation signal generated based on the pulse position, and can improve sound quality.

It is an object of the present invention to provide a speech coding/decoding method that can resolve a saturation phenomenon occurring when a pulse position is fixed at an integer position using a method of adapting a pulse position candidate, which is provided by U.S. patent application Ser. No. 09/220,062, the contents of which are incorporated herein by reference. The method can improve speech quality by making effective use of adapting the pulse position candidate.

According to the invention, there is provided a speech coding method which comprises: analyzing an input speech signal to divide the input speech signal into a parameter representing a frequency characteristic of a speech and an excitation signal which is an input signal of a synthesis filter generated based on the parameter, to output a first index specifying the parameter representing the frequency characteristic as a coded result, the excitation signal being formed of a pulse train including a pulse selected from first pulses and second pulses, the first pulses being set at first positions located on sampling points of the excitation signal and the second pulses being set at second positions located between sampling points of the excitation signal; generating a synthesized speech signal based on the coded result and the excitation signal; generating a second index indicating a parameter with which an error between the input speech signal and the synthesized speech signal is minimized; selecting a pulse position candidate from a pulse position codebook in accordance with the second index; and outputting the first and second indexes.

According to the invention, there is provided a speech decoding method which comprises: extracting, from a coded stream, a first index indicating a frequency characteristic of a speech, a second index indicating a pitch vector, and a third index indicating a pulse train of an excitation signal; reconstructing a synthesis filter by decoding the first index; reconstructing the pitch vector on the basis of the second index; reconstructing on the basis of the third index the excitation signal formed by using a pulse train including a pulse selected from first pulses and second pulses, the first pulses being set on sampling points of the excitation signal, and the second pulses being set at positions located between sampling points of the excitation signal, and generating a decoded speech signal by exciting a synthesis filter by means of the reconstructed excitation signal and pitch vector.

In other words, the present invention provides a speech coding/decoding method in which an excitation signal is formed by using a pulse train, and the pulse train contains a pulse selected from first pulses set on sampling points of the excitation signal and second pulses set at positions located between sampling points of the excitation signal.

According to the invention, there is provided a speech coding method which comprises: analyzing an input speech signal to divide the input speech signal into a parameter representing a frequency characteristic of a speech and an excitation signal formed based on the parameter and input to a digital filter, to output a first index specifying the parameter representing the frequency characteristic as a coded result, the excitation signal being generated by using a pitch vector and a stochastic vector for exciting a synthesis filter; generating the stochastic vector by using a pulse train including a pulse selected from first pulses and second pulses, the first pulses being set on sampling points of the stochastic vector and the second pulses being set at set positions located between sampling points of the stochastic vector; generating a synthesized speech signal based on the coded result and the excitation signal; and generating a second index with which an error between the input speech signal and the synthesized speech signal is minimized.

According to the invention, there is provided a speech decoding method which comprises: extracting, from a coded stream, a first index indicating a frequency characteristic of a speech, a second index indicating a pitch vector, and a third index indicating a pulse train of an excitation signal; reconstructing a synthesis filter by decoding the first index; reconstructing the pitch vector on the basis of the second index; reconstructing on the basis of the third index the excitation signal formed by using a pulse train including a pulse selected from first pulses and second pulses, the first pulses being set on sampling points of the excitation signal, and the second pulses being set at a position between sampling points of the excitation signal; and generating a decoded speech signal by exciting a synthesis filter on the basis of the reconstructed excitation signal.

In other words, the present invention provides a speech coding/decoding method in which an excitation signal is constituted by a pitch vector and stochastic vector, and the stochastic vector is formed by using a pulse train containing a pulse selected from first pulses set on sampling points of the stochastic vector and second pulses set at positions located between sampling points of the stochastic vector.

According to the invention, there is provided a speech coding method which comprises: analyzing an input speech signal to divide the input speech signal into a parameter representing a frequency characteristic of a speech and an excitation signal formed based on the parameter and input to a digital filter, to output a first index specifying the parameter representing the frequency characteristic as a coded result, the excitation signal being generated by using a pitch vector and a stochastic vector for exciting a synthesis filter; selecting a predetermined number of pulse positions from pulse position candidates to be adapted on the basis of a shape of the pitch vector, the pulse position candidates including first pulse position candidates set on sampling points of the stochastic vector and second pulse position candidates set at positions located between sampling points of the stochastic vector; arranging pulses at the predetermined number of pulse positions to generate a pulse train to be used for generating the stochastic vector; generating a synthesized speech signal on the basis of the coded result and the excitation signal; generating a second index indicating a parameter with which an error between the input speech signal and the synthesized speech signal is minimized; selecting the pulse position candidates from a pulse position codebook in accordance with the second index; and outputting the first and second indexes.

According to the invention, there is provided a speech decoding method which comprises: extracting, from a coded stream, a first index indicting a frequency characteristic of a speech and a second index indicating an excitation signal; reconstructing a synthesis filter by decoding the first index; reconstructing the excitation signal on the basis of the second index, the excitation signal being constituted by a stochastic vector and a pitch vector, the stochastic vector being formed by a pulse train generated by arranging pulses at a predetermined number of pulse positions selected from pulse position candidates to be adapted on the basis of a shape of the pitch vector, and the pulse position candidates including first pulse position candidates and second pulse position candidates, the first pulse position candidates being set on sampling points of the stochastic vector and the second pulse position candidates being set at positions located between sampling points of the stochastic vector; and decoding a speech signal by exciting a synthesis filter by means of the excitation signal.

In other words, the present invention provides a speech coding/decoding method in which an excitation signal is constituted by a pitch vector and stochastic vector, and the stochastic vector is formed by using a pulse train generated by arranging pulses at a predetermined number of pulse positions selected from pulse position candidates subjected to adapting on the basis of the pitch vector. In this method, the pulse position candidates are formed by using a pulse train containing a pulse selected from the first pulses set on sampling points of the stochastic vector and the second pulses set at positions located between sampling points of the stochastic vector.

According to CELP scheme using an algebraic codebook, the number of pulse position candidates is limited to the number of sampling points of an excitation signal/stochastic vector or less. In contrast to this, according to the present invention, an infinite number of pulse position candidates can be theoretically set by adding positions between sampling points to the above sampling points. As a consequence, many coded bits can be assigned to pulse position candidates regardless of the number of samples. This makes it possible to improve the sound quality of a decoded speech signal and coding efficiency.

According to the invention, there is provided a speech coding apparatus comprising: a speech analyzer section configured to analyze an input speech signal to divide the input speech signal into a parameter representing a frequency characteristic of a speech and an excitation signal which is an input signal of a synthesis filter generated based on the parameter, to output a first index specifying the parameter as a coded result; a pulse excitation section configured to generate a pulse train, as the excitation signal, which includes a pulse selected from first pulses and second pulses, the first pulses being set at first positions located on sampling points of the excitation signal and the second pulses being set at second positions located between sampling points of the excitation signal; a speech synthesizer section configured to generate a synthesized speech signal based on the coded result and the excitation signal; an index output section configured to generate a second index indicating a parameter with which an error between the input speech signal and the synthesized speech signal is minimized; a pulse position codebook which stores pulse position candidates; a selector section which selects a pulse position candidate from the pulse position codebook in accordance with the second index; and an output section which outputs the first and second indexes.

According to the invention, there is provided a speech decoding apparatus comprising: a demultiplexer section that extracts, from a coded stream, a first index indicating a quantized value, a second index indicating a pitch vector, and a third index indicating a pulse train of an excitation signal; a dequantizer section which reconstructs the quantized value by decoding the first index; a pitch vector reconstructing section which reconstructs the pitch vector based on the second index; an excitation signal reconstructing section which reconstructs the excitation signal formed by using a pulse train including a pulse selected from first pulses and second pulses, the first pulses being set on sampling points of the excitation signal, and the second pulses being set at positions located between sampling points of the excitation signal on the basis of the third index; and a coding section which generates a decoded speech signal by exciting a synthesis filter by means of the reconstructed excitation signal and pitch vector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
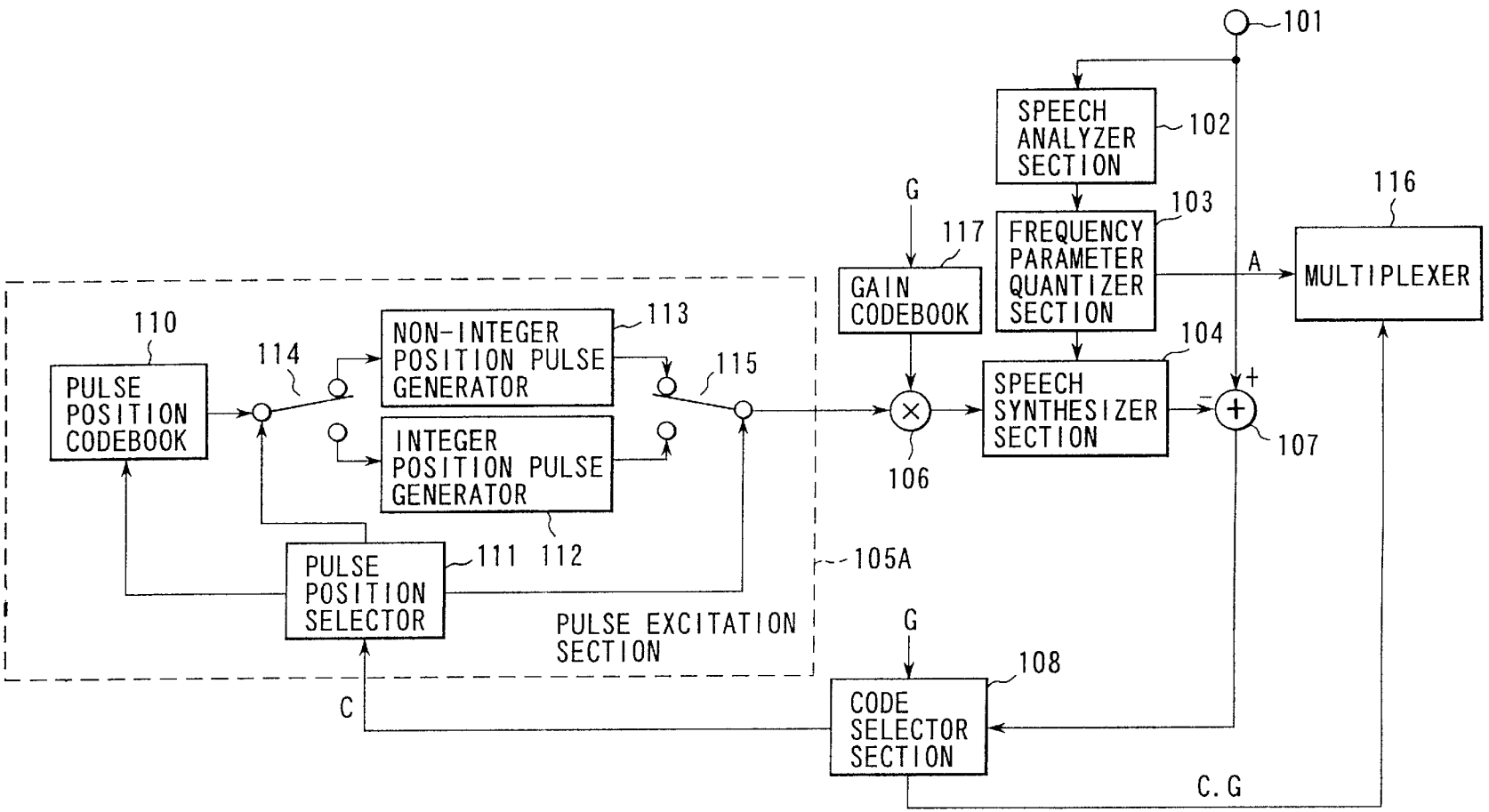
FIG. 1 is a block diagram showing a speech coding system according to the first embodiment of the present invention.

A speech signal coding system to which a speech signal coding/decoding method according to the first embodiment of the present invention is applied will be described with reference to FIG. 1.

This speech signal coding system comprises an input terminal 101, a speech analyzer section (LPC analyzer) 102, a frequency parameter quantizer section (LPC quantizer) 103, a speech synthesizer section (LPC synthesizer) 104, a pulse excitation section 105A, a gain multiplier 106, a subtracter section 107, and a code selector section 108.

The pulse excitation section 105A is constituted by a pulse position codebook 110, a pulse position selector 111, an integer position pulse generator 112, a non-integer position pulse generator 113, and switches 114 and 115.

An input speech signal to be coded is input to the input terminal 101 1-frame lengths. The speech analyzer section 102 performs linear predictive analysis in synchronism with this input operation to obtain linear predictive coefficients (LPC coefficients) corresponding to vocal tract characteristics. The LPC coefficients are quantized by the frequency parameter quantizer section 103. This quantized value is input to the speech synthesizer section 104 as synthesis filter information representing the characteristics of a synthesis filter constructing the speech synthesizer section 104, and an index A indicating the quantized value is output as a coding result to a multiplexer section 116.

In the pulse excitation section 105A, the pulse position selector 111 selects pulse position candidates stored in the pulse position codebook 110 in accordance with an index (code) C input from the code selector section 108. In this case, as will be described in detail later, integer pulse positions at which pulses are set at integer sampling points of an excitation signal are stored in the pulse position codebook 110, together with non-integer pulse positions at which pulses are set at non-integer sampling points. The number of pulse position candidates to be selected by the pulse position selector 111 is generally predetermined. More specifically, one or several candidates are generally selected.

The pulse position selector 111 controls the switches 114 and 115 depending on whether a selected pulse position candidate is an integer pulse position or non-integer pulse position. If the selected pulse position candidate is an integer pulse position, the integer position pulse (first pulse) generated by the integer position pulse generator 112 is output. If the selected pulse position candidate is a non-integer pulse position, the non-integer position pulse (second pulse) generated by the non-integer position pulse generator 113 is output. The respective pulses obtained in this manner are synthesized into a pulse train of one system and output from the pulse excitation section 105A.

The gain multiplier 106 gives a gain (including polarity) selected from a gain codebook 117 in accordance with an index G to each pulse of the pulse train output from the pulse excitation section 105A or the entire pulse train. The resultant pulse train is then input to the speech synthesizer section 104 as an excitation signal. The excitation signal produced by such a way corresponds to the signal obtained by quantizing a predictive residual signal based on the linear predictive analysis, and also to a vocal signal including information representing pitch period of the speech.

The speech synthesizer section 104 is formed by using a recursive digital filter called a synthesis filter, which generates a synthesized speech signal from the input pulse train. The subtracter section 107 obtains the distortion of this synthesized speech signal, i.e., the error between the synthesized speech signal and input speech signal, and inputs it to the code selector section 108. In general, when the error is calculated, the gain to be given to the pulse train is set to an optimal value.

The code selector section 108 evaluates the distortion (the difference between the synthesized speech signal and input speech signal) of the synthesized speech signal generated by the speech synthesizer section 104 in correspondence with the index C, selects the index C corresponding to the minimum distortion, and outputs the index C to the multiplexer section 116, together with the index G indicating the gain.

This embodiment has the features that non-integer pulse positions are added to the pulse position candidates stored in the pulse position codebook 110 in the pulse excitation section 105A, and the non-integer position pulse generator 113 for generating non-integer position pulses is added to the section 105A accordingly, in addition to the integer position pulse generator 112. A method of generating non-integer position pulses will be described below with reference to FIGS. 2A and 2B.

Figure 2A:
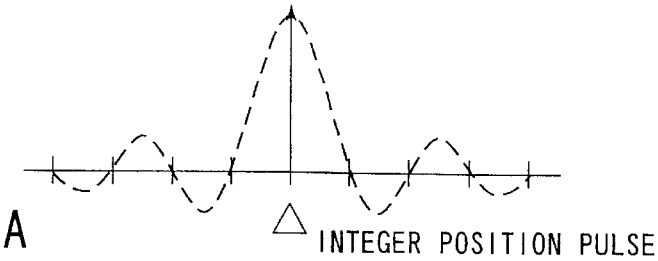
FIGS. 2A and 2B are graphs for explaining a method of generating non-integer position pulses in the present invention.

FIG. 2A shows a method of generating pulses to be generally used, i.e., integer position pulses in this embodiment. The symbol "Δ" indicates a pulse position, and the thick arrow indicates an integer position pulse (first pulse) set at the pulse position. The short vertical lines indicate the sampling points of the excitation signal. In the prior art, a pulse position is set on only such a sampling point.

According to the sampling theorem, the continuous values of a waveform, in which a value exists at only a pulse position with 0 set at the remaining positions, become identical, at discrete values, to the waveform indicated by the dashed line in FIG. 2A, which is called an interpolation filter. If this waveform is sampled as an excitation signal waveform at sampling points set at predetermined intervals, since the value of the excitation signal waveform represented by the dashed line indicates 0 at the sampling points other than the pulse position, a value exists at only the pulse position.

Figure 2B:
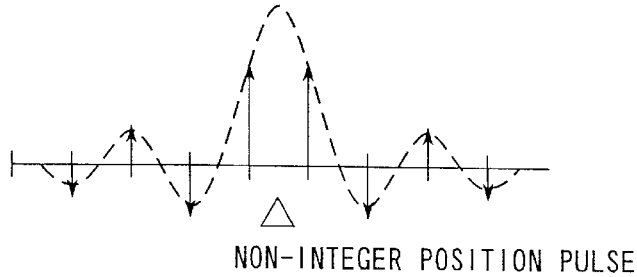

FIG. 2B shows a method of non-integer position pulses (second pulses) according to the present invention. Referring to FIG. 2B, the symbol "Δ" indicates a pulse position, which is set between sampling points. In this case, the pulse position is set at the midpoint between sampling points. The waveform represented by the dashed line indicates the continuous value of a pulse set at this pulse position. Discrete values can be obtained by sampling this waveform as an excitation signal waveform at sampling points set at predetermined intervals. The thick arrows indicate the sampled values.

In this embodiment, non-integer position pulses are represented by a set of a plurality of pulses set at the sampling points before and after the pulse position. The waveform represented by the dashed line has an infinite width. In practice, however, this waveform is cut by a finite length and expressed by a set of several pulses. When such a waveform is to be cut, an appropriate window such as a hamming window may be applied to the waveform, as needed. A larger number of pulses make the resultant waveform more similar to the waveform before cutting, and hence are preferable. However, satisfactory performance can be obtained with a set of two pulses including only the pulses on the two sides of the pulse position indicated by the symbol "Δ".

Figure 3:
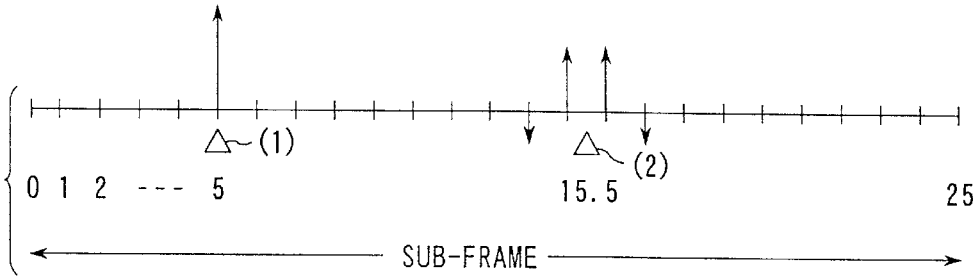
FIG. 3 is a graph showing a pulse train output from a pulse excitation section in the present invention.

FIG. 3 shows an example of the pulse train output from the pulse excitation section 105A. According to the CELP scheme, an excitation signal to be input to the speech synthesizer section 104 is generated in predetermined frame (sub-frame) lengths. In the scheme using a pulse excitation in this embodiment, an excitation signal is generated by setting several pulses within this sub-frame. FIG. 3 shows a pulse train having a frame length of 26 and a pulse count of 2. Referring to FIG. 3, the symbol "Δ" (1) indicates an integer pulse position, which corresponds to 5, and the symbol "Δ" (2) indicates a non-integer pulse position, which corresponds to 15.5. The pulse at this non-integer pulse position is represented by a set of four pulses.

The pulse excitation section 105A selects the pulse position candidate indicated by the index C from the pulse position codebook 110, and generates a pulse train shown in FIG. 3 by selectively using the integer position pulse generator 112 and non-integer position pulse generator 113 in units of pulses. A pulse train may be constituted by only integer position pulses or by only non-integer position pulses. Finally, a pulse position candidate with which the distortion with respect to a target vector is minimized is selected.

By using non-integer position pulses in addition to integer position pulses, the number of pulse position candidates that can be stored in the pulse position codebook 110 theoretically becomes infinite. This makes it possible to set a pulse position with higher precision.

A speech decoding system according to this embodiment which corresponds to the speech coding system in FIG. 1 will be described next with reference to FIG. 4.

This speech decoding system comprises a frequency parameter dequantizer section (LPC quantizer) 203, a speech synthesizer section (LPC synthesizer) 204, a pulse excitation section 205A, and a gain multiplier 206. Similar to the pulse excitation section 105A in FIG. 1, the pulse excitation section 205A is constituted by a pulse position codebook 210, a pulse position selector 211, an integer position pulse generator 212, a non-integer position pulse generator 213, and switches 214 and 215.

A coded stream transmitted from the speech coding system in FIG. 1 is input to this speech decoding system. A demultiplexer 200 demultiplexes this coded stream into the index A indicating the quantized LPC coefficient used by the speech synthesizer section 204, the index C indicating the position information of each pulse of the pulse train generated by the pulse excitation section 205A, and the index G indicating a gain.

The frequency parameter dequantizer section 203 decodes the index A to obtain quantized LPC coefficients. This quantized LPC coefficients are supplied as synthesis filter coefficients to the speech synthesizer section 204.

The index C is input to the pulse position selector 211 of the pulse excitation section 205A. In the pulse excitation section 205A, as in the pulse excitation section 105A in FIG. 1, the pulse position selector 211 selects pulse position candidates including both integer and non-integer positions stored in the pulse position codebook 210 in accordance with the index C, and the switches 214 and 215 are controlled depending on whether each pulse position candidate selected by the pulse position selector 211 is an integer or non-integer position.

If the pulse position candidate selected by the pulse position selector 211 is an integer position, the integer position pulse generated by the integer position pulse generator 212 is output. If the selected pulse position candidate is a non-integer position, the non-integer position pulse generated by the non-integer position pulse generator 213 is output. These pulses are synthesized into a pulse train of one system. This pulse train is then output from the pulse excitation section 205A.

The gain multiplier 206 gives the gain obtained from a gain codebook 216 in accordance with the index G to each pulse of the pulse train output from the pulse excitation section 205A or the entire pulse train. The resultant pulse train is input to the speech synthesizer section 204. The speech synthesizer section 204 is formed by using a synthesis filter similar to that of the speech synthesizer section 104 in FIG. 1. The speech synthesizer section 204 generates a synthesized speech signal (decoded speech signal) from the input pulse train.

As described above, according to this embodiment, since non-integer position pulses are used in addition to integer position pulses in the prior art to form a pulse train forming an excitation signal for exciting the synthesis filter, the number of pulse position candidates that can be stored in the pulse position codebooks 110 and 210 theoretically becomes infinite. A larger number of coded bits can therefore be assigned to pulse position candidates, and hence speech coding/decoding with high sound quality can be realized.

Figure 5:
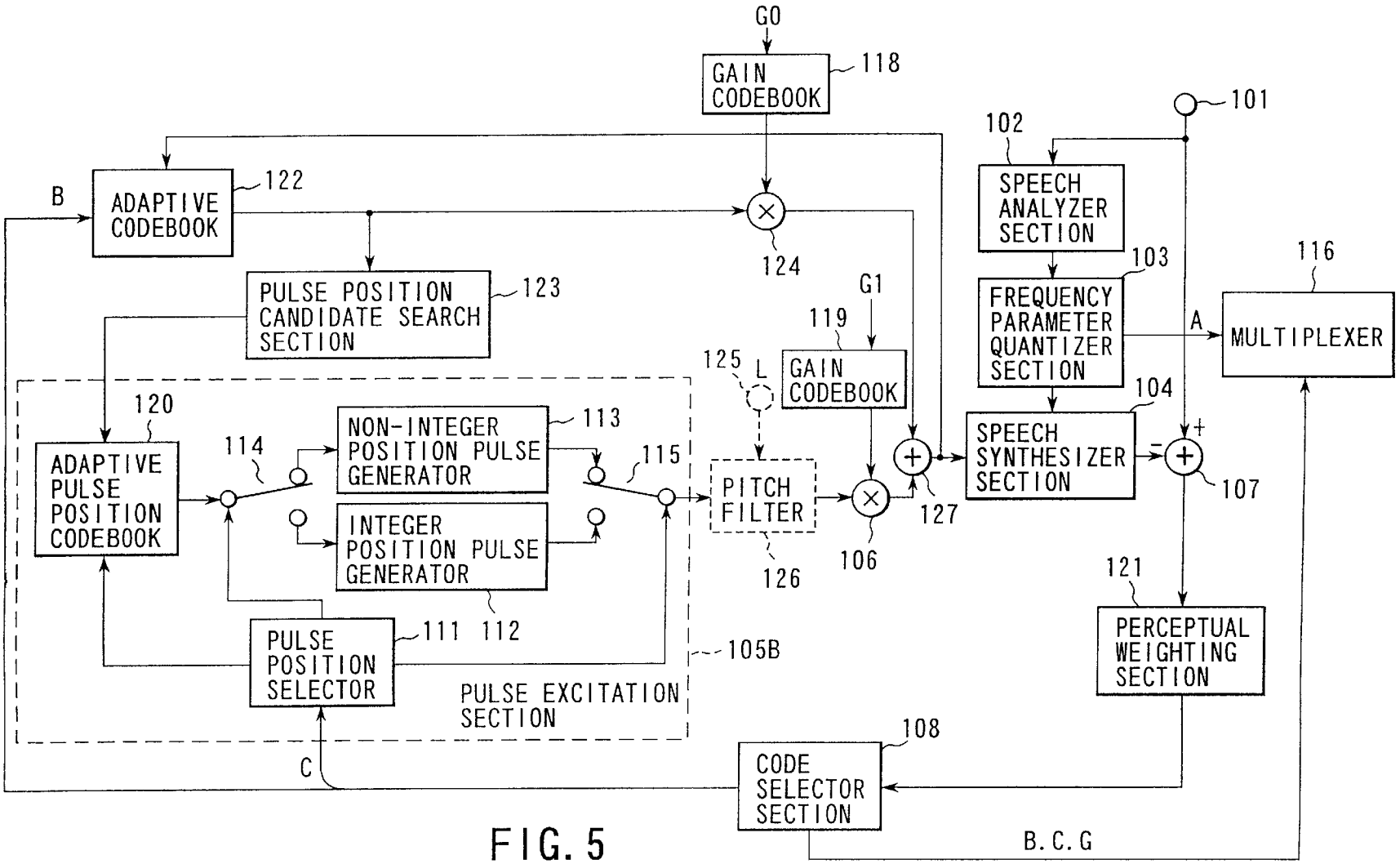
FIG. 5 is a block diagram showing a speech coding system according to the second embodiment of the present invention.

FIG. 5 shows the arrangement of a speech coding system to which a speech coding method according to the second embodiment of the present invention is applied.

This speech coding system forms an excitation signal for exciting the synthesis filter of a speech synthesizer section 104 by using a pitch vector and stochastic vector. The same reference numerals as in FIG. 5 denote the same parts in FIG. 1. In addition to the components of the speech coding system of the first embodiment, this speech coding system includes a perceptual weighting section 121, an adaptive codebook 122, a pulse position candidate search section 123, a gain multiplier 124, an input terminal 125, a pitch filter 126, and an adder 127. In addition, in a pulse excitation section 105B, the pulse position codebook 110 in FIG. 1 is replaced with an adaptive pulse position codebook 120.

An input speech signal to be encoded is input to an input terminal 101 in 1-frame lengths. As in the speech coding system of the first embodiment, quantized LPC coefficients are generated through a speech analyzer section 102 and a frequency parameter quantizer section 103, and a corresponding index A is output.

The speech synthesizer section 104 produces a synthesized speech signal from the quantized value of the LPC coefficients and excitation signal. The subtracter 107 calculates an error between the synthesized speech signal and the input speech signal. The difference is perceptually weighted by the perceptual weighting section 121 and then input to a code selector section 108.

The code selector section 108 outputs an index B indicating a pitch vector by which the power of the difference between the synthesized speech signal and the input speech signal and weighted by the perceptual weighting section 121 is minimized, an index C indicating a pulse train selected from the adaptive pulse position codebook 120, and an index G indicating a gain selected from the gain codebooks 118 and 119. The indexes B, C and G are multiplexed together with the index A indicating speech filter information corresponding to the quantized value of the LPC coefficients from the frequency parameter quantizer section 103 by the multiplexer 116. The multiplexed result is transmitted as a coded stream to a decoder.

Note that a code vector obtained from a fixed codebook may be used for an onset or the like of speech in place of a pitch vector. In the present invention, these vectors will be generically called pitch vectors.

The pitch vectors of excitation signals input to the speech synthesizer section 104 in the past are stored in the adaptive codebook 122. One pitch vector is selected from the adaptive codebook 122 in accordance with an index B from the code selector section 108. The gain multiplier 124 multiplies the pitch vector selected from the adaptive codebook 122 by the gain obtained from a gain codebook 118 in accordance with an index G0. The resultant vector is input to the adder 127.

The pulse position candidate search section 123 generates pulse position candidates in a sub-frame which are made adaptive on the basis of the shape of the pitch vector selected from the adaptive codebook 122. If the number of bits assigned to the pulse position candidates is small, there are not enough bits to set all samples in the sub-frame as pulse position candidates. In this embodiment, therefore, efficient pulse positions are selected by the method disclosed in U.S. Ser. No. 09/220,062. In this case, if pulse position candidates include not only integer pulse positions but also non-integer pulse positions, pulse position candidates can be made adaptive more effectively.

The pulse position candidates obtained in this manner are stored in the adaptive pulse position codebook 120. Although only some of the pulse positions (including non-integer pulse positions) in a sub-frame are stored in the adaptive pulse position codebook 120, a synthesized speech signal with high sound quality can be obtained at a low bit rate because these candidates are minority candidates that are made adaptive on the basis of the shape of the pitch vector.

The pulse excitation section 105B outputs a pulse train by the same technique as that used in the speech coding system of the first embodiment. The pitch filter 126 makes this pulse train periodic in units of pitches, as needed, in accordance with pitch period information L supplied to the input terminal 125.

A gain multiplier 106 multiplies the pulse train, which is output from the pulse excitation section 105B and made periodic in units of pitches by the pitch filter 126 as needed, by the gain obtained from a gain codebook 119 in accordance with an index G1, and inputs the resultant signal to the adder 127. The adder 127 adds this signal to the pitch vector which is selected from the adaptive codebook 122 and multiplied by the gain by the gain multiplier 124. The output signal from the adder 127 is supplied as an excitation signal for the synthesis filter to the speech synthesizer section 104.

As described above, this embodiment has the features that adapting of pulse position candidates including non-integer pulse position candidates as well as integer pulse position candidates is performed by the pulse position candidate search section 123 on the basis of the shape of a pitch vector. This greatly improves the adapting effect.

Figure 6:
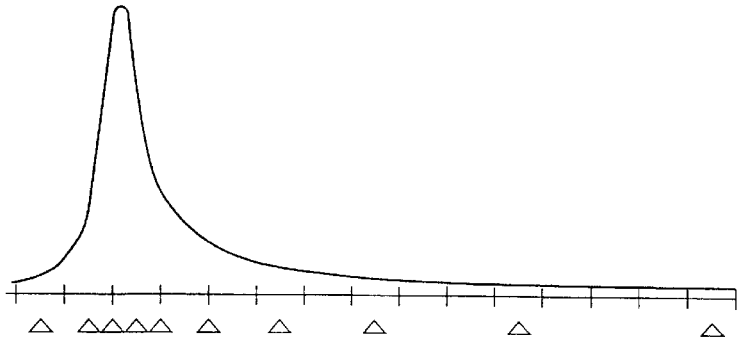
FIG. 6 is a graph showing how adapting of pulse position candidates is performed by using non-integer pulse positions in the second embodiment.

This effect will be described below with reference to FIG. 6. Referring to FIG. 6, the short vertical lines indicate sampling points; the symbols "Δ", pulse position candidates selected by adapting; and the waveform, the amplitude envelope of a pitch vector. The numbers of sampling points and pulse position candidates in the sub-frame are 16 and 10, respectively. In this embodiment, adapting is performed for pulse position candidates including non-integer pulse positions corresponding to ½ sampling points as well as integer pulse positions. In this case, pulse position candidates can be arranged such that pulse position candidates concentrate on the focal point of power, and reductions in power and the number of pulse position candidates can be attained. Obviously, therefore, the adapting function of this embodiment is effective. When the number of pulse position candidates is large as in this case, saturation of the number of pulse position candidates can be avoided by using non-integer pulse positions according to the present invention. This makes it possible to maximize the adapting effect.

A speech decoding system according to this embodiment which corresponds to the speech coding system in FIG. 5 will be described next with reference to FIG. 7.

Figure 4:
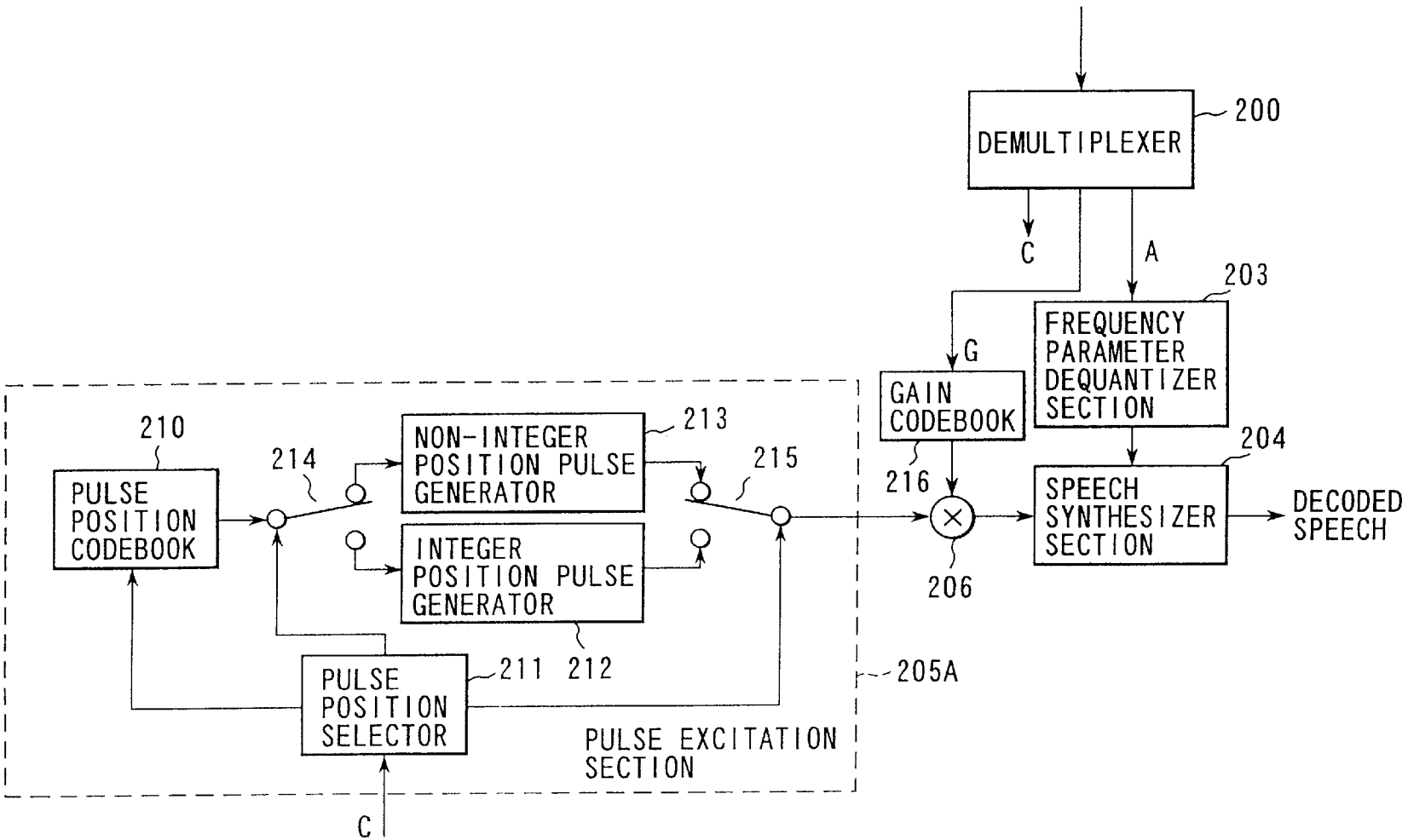
FIG. 4 is a block diagram showing a speech decoding system according to the first embodiment of the present invention.
Figure 7:
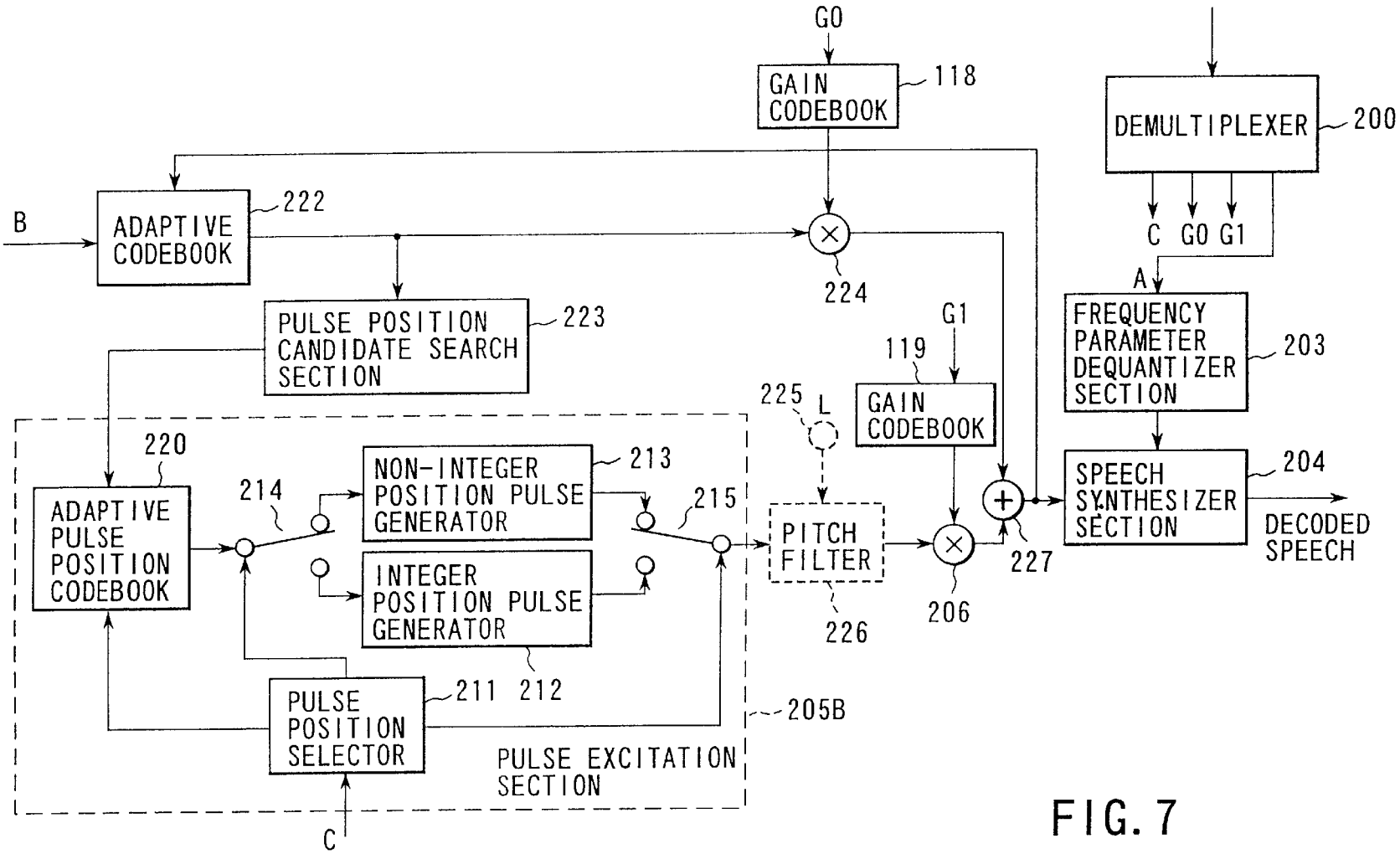
FIG. 7 is a block diagram showing a speech decoding system according to the second embodiment of the present invention.

The same reference numerals as in FIG. 7 denote parts having the same functions in FIG. 4. The speech decoding system in FIG. 7 is comprised of a frequency parameter dequantizer section 203, a speech synthesizer section 204, a pulse excitation section 205B, a gain multiplier 206, an adaptive codebook 222, a pulse position candidate search section 223, an input terminal 225 for pitch period information, a pitch filter 226, and an adder 227. Similar to the pulse excitation section 105B in FIG. 5, the pulse excitation section 205B is constituted by an adaptive pulse position codebook 220, a pulse position selector 211, an integer position pulse generator 212, a non-integer position pulse generator 213, and switches 214 and 215.

A coded stream transmitted from the speech coding system in FIG. 5 is input to this speech decoding system. The demultiplexer 200 demultiplexes this coded stream into an index A representing the quantized LPC coefficient used by the speech synthesizer section 204, an index C representing the position information of each pulse of the pulse train generated by the pulse excitation section 205B, and indexes G0 and G1 representing gains.

A frequency parameter dequantizer section 201 decodes the index A to obtain quantized LPC coefficients. This quantized LPC coefficients are supplied as synthesis filter coefficients to the speech synthesizer section 204.

The index C is input to the pulse position selector 211 of the pulse excitation section 205B. In the pulse excitation section 205B, as in the pulse excitation section 105B in FIG. 5, the pulse position selector 211 selects pulse position candidates including integer pulse positions and non-integer pulse positions stored in the adaptive pulse position codebook 220 in accordance with the index C, and the switches 214 and 215 are controlled depending on whether each pulse position candidate selected by the pulse position selector 211 is an integer pulse position or non-integer pulse position.

If the pulse position candidate selected by the pulse position selector 211 is an integer pulse position, the integer position pulse generated by the integer position pulse generator 212 is output. If the selected pulse position candidate is a non-integer pulse position, the non-integer position pulse generated by the non-integer position pulse generator 213 is output. These pulses are synthesized into a pulse train of one system and output from the pulse excitation section 205B.

The pulse train output from the pulse excitation section 205B is made periodic, as needed, in units of pitches by the pitch filter 226 in accordance with pitch period information L supplied to the input terminal 225. The gain multiplier 206 supplies the gain obtained from a gain codebook 119 in accordance with the index G1 to each pulse or the entire pulse train. The resultant data is input to the adder 227. The adder 227 adds this data to the pitch vector selected from the adaptive codebook 222 and multiplied by the gain obtained from a gain codebook 118 in accordance with the index G0 by the deletion request data 224. The output signal from the adder 227 is supplied as an excitation signal for the synthesis filter to the speech synthesizer section 204, thereby generating a synthesized speech signal (decoded speech signal).

As described above, according to this embodiment, pulse position candidates can be arranged with high fidelity in accordance with the shape of a pitch vector by performing adapting of the pulse position candidates including non-integer pulse positions on the basis of the shape of the pitch vector. This solves the problem of saturation of the number of pulse position candidates, and hence can realize coding/decoding with high sound quality. This effect becomes conspicuous especially when the number of pulse position candidates is large.

Figure 8:
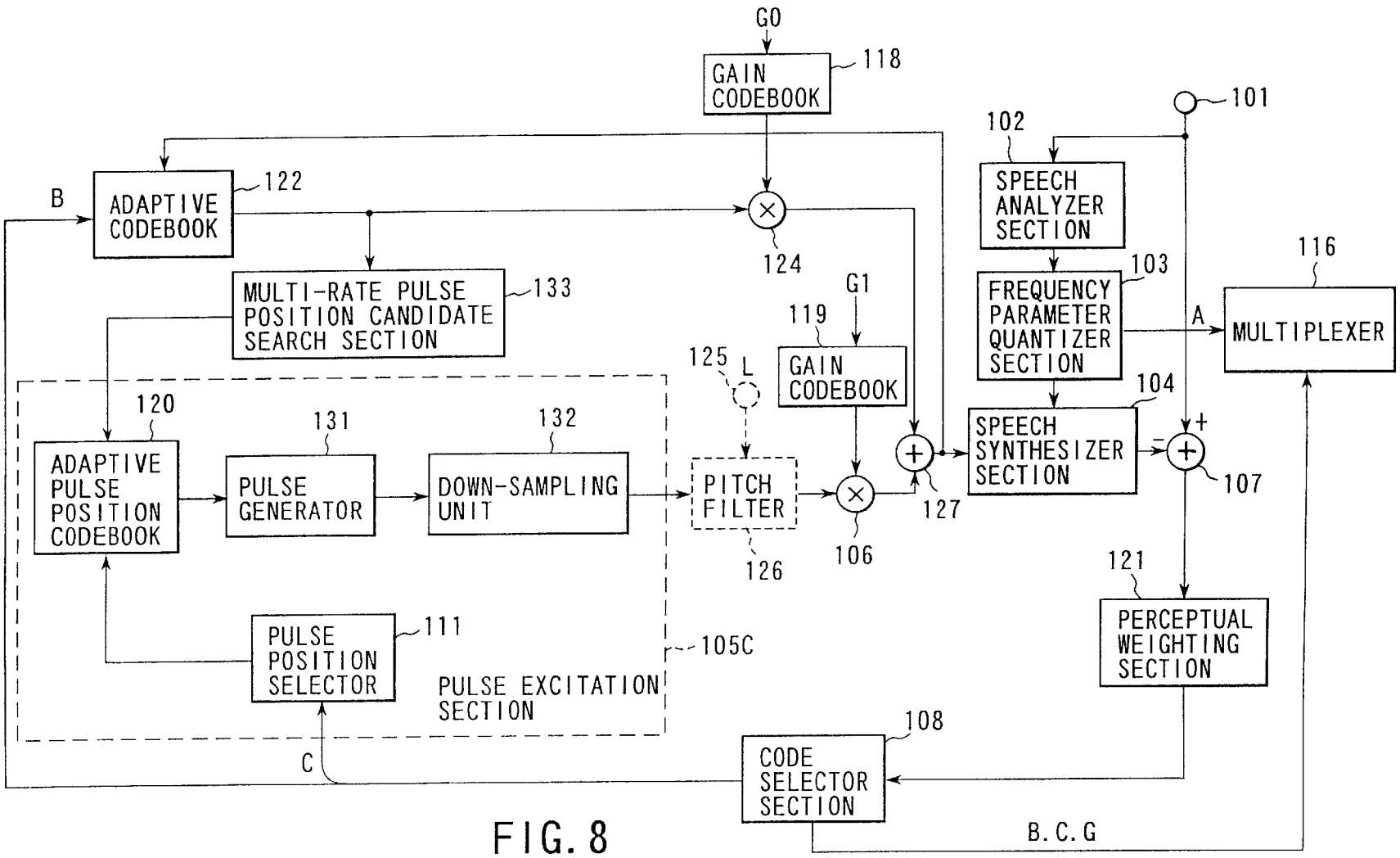
FIG. 8 is a block diagram showing a speech coding system according to the third embodiment of the present invention.

FIG. 8 shows the arrangement of a speech coding system to which a speech coding method according to the third embodiment of the present invention is applied. This speech coding system is functionally the same as the speech coding system in FIG. 5, but differs in implementation means.

The same reference numerals as in FIG. 5 denote the same parts in FIG. 8. This speech coding system differs from the speech coding system of the second embodiment in FIG. 5 in that a pulse excitation section 105C comprises an adaptive pulse position codebook 120, a pulse generator 131, a down-sampling unit 132, and a pulse position selector 111, and a multi-rate pulse position candidate search section 133 is used in place of the pulse position candidate search section 123.

The multi-rate pulse position candidate search section 133 outputs pulse position candidates obtained by up-sampling a stochastic vector. More specifically, when non-integer pulse position candidates up to 1/N sample are to be handled, the multi-rate pulse position candidate search section 133 converts non-integer pulse position candidates into integer pulse position candidates by performing N-times up-sampling. If the number of sampling points of a stochastic vector in a frame is M, the pulse position candidate search section 123 in FIG. 5 outputs integer pulse positions or non-integer pulse positions in increments of 1/N within the range of 0 to M−1. In contrast to this, the multi-rate pulse position candidate search section 133 outputs integer pulse positions within the range of 0 to NM−1.

As a consequence, all the pulse position candidates stored in the adaptive pulse position codebook 120 are integral values, which are equal to N times actual pulse positions. The pulse generator 131 receives the pulse position candidates extracted from the adaptive pulse position codebook 120, and obtains a pulse train of a length of NM by setting pulses during N times up-sampling. The down-sampling unit 132 obtains a pulse train having a length of M by performing 1/N times down-sampling this pulse train.

In this embodiment, the pulses output from the pulse generator 131, and arranged in an up-sampled state, are finally down-sampled by the down-sampling unit 132. In the above second embodiment, these down-sampled pulses are prepared as a set of pulses corresponding to non-integer pulse positions to obtain an equivalent effect without actually performing up-sampling. In some cases, however, a better effect can be obtained by actually performing up-sampling, as in this embodiment, depending on the configuration of programs and the like.

As other methods of outputting the pulse position candidates converted into integral values by the multi-rate pulse position candidate search section 133, various methods can be used. For example, the same effect as described above can be obtained by performing adapting of pulse positions using only integer pulse positions after up-sampling of a pitch vector.

Figure 9:
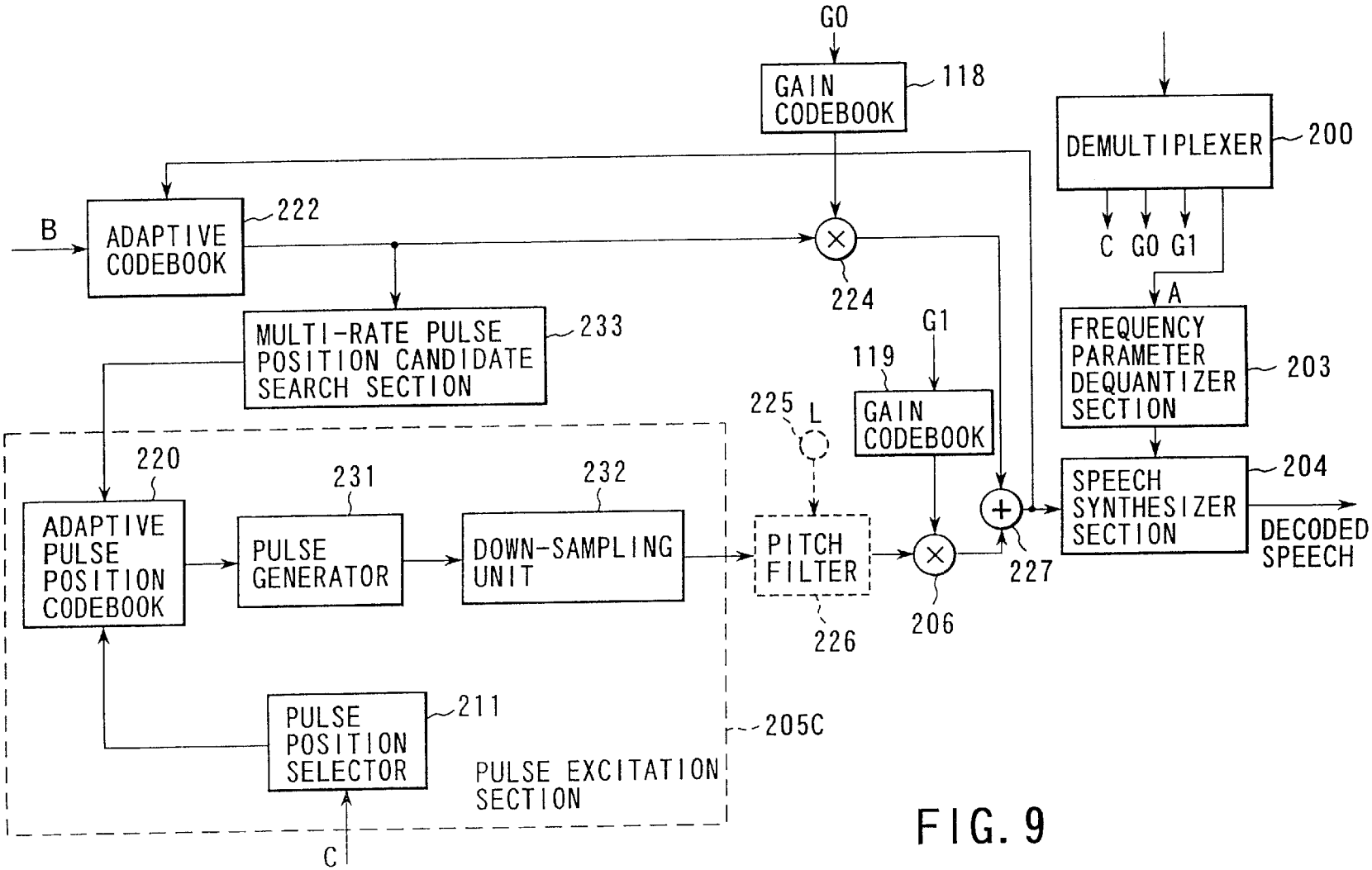
FIG. 9 is a block diagram showing a speech decoding system according to the third embodiment of the present invention.

FIG. 9 shows the arrangement of a speech decoding system of this embodiment corresponding to the speech coding system in FIG. 8. This speech decoding system differs from the speech decoding system in FIG. 7 in that a pulse excitation section 205C comprises an adaptive pulse position codebook 220, a pulse generator 231, a down-sampling unit 232, and a pulse position selector 211 like the pulse excitation section 105C in FIG. 8. A multi-rate pulse position candidate search section 233 is used in place of the pulse position candidate search section 223.

According to the speech decoding system, the coded stream is demultiplexed into the index A indicating the quantized LPC coefficients, C indicating the position information of each pulse of the pulse train, and indexes G0, G1 indicating the gain by a demultiplexer section 200.

The index A is decoded by the frequency parameter dequantizer to obtain quantized LPC coefficients to be supplied to the speech synthesizer 204 as synthesized filter coefficients.

The multi-rate pulse position candidate search section 233 outputs pulse position candidates obtained by up-sampling the stochastic vector. In other words, in a case of non-integer pulse position candidates up to 1/N samples, the multi-rate pulse position candidate search section 233 converts the non-integer pulse position candidates into the integer pulse position candidates by up-sampling of N times. When the number of sampling points of the stochastic vector within a frame is M, the multi-rate pulse position candidate search section 233 generates integer pulse positions within a range of 0 to NM−1.

As a result, although all of the pulse position candidates stored in the adaptive pulse position codebook 220 becomes integer values, they are equal to M times of an actual pulse position. The pulse generator 231 receives the pulse position candidates selected from the adaptive pulse position codebook 220 in accordance with the index C and sets pulses to the candidates subjected to the up-sampling of N times thereby to generates a pulse train having a length of NM. The down-sampling section 232 down-samples the pulse train to 1/N times to generate a pulse train having a length of M.

The pulse train output from the pulse excitation section 205C is made periodic, as needed, in units of pitches by the pitch filter 226 in accordance with pitch period information L supplied to the input terminal 225. The gain multiplier 206 supplies the gain obtained from a gain codebook 119 in accordance with the index G1 to each pulse or the entire pulse train. The resultant data is input to the adder 227. The adder 227 adds this data to the pitch vector selected from the adaptive codebook 222 and multiplied by the gain obtained from a gain codebook 118 in accordance with the index G0 by the deletion request data 224. The output signal from the adder 227 is supplied as an excitation signal for the synthesis filter to the speech synthesizer section 204, thereby generating a synthesized speech signal (decoded speech signal).

As has been described above, according to the present invention, when a pulse train forming an excitation signal for a synthesis filter is to be generated, many pulse position candidates can be used regardless of the number of sampling points in a frame. This makes it possible to realize coding/decoding with high sound quality.

In addition, when adapting of pulse position candidates is performed, pulse position candidates can be arranged with high fidelity in accordance with the shape of a pitch vector. This solves the problem of saturation of the number of pulse position candidates, and can realize speech coding/decoding with high sound quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech coding method, comprising:

analyzing an input speech signal (1) to divide the input speech signal into a parameter representing a frequency characteristic of speech and an excitation signal, the excitation signal being an input signal to a synthesis filter, the synthesis filter generated based on the parameter, and (2) to output a first index specifying the parameter as a coded result, the excitation signal being formed of a pulse train including pulses selected from first pulses and second pulses, the first pulses being set at first positions located on sampling points of the excitation signal, and the second pulses being set at second positions located between the sampling points of the excitation signal;

generating a synthesized speech signal based on the coded result and the excitation signal;

generating a second index indicating a parameter with which an error between the input speech signal and the synthesized speech signal is minimized;

selecting a pulse position candidate from a pulse position codebook in accordance with the second index; and outputting the first and second indexes.

2. The method according to claim 1, further comprising:

storing the first positions and the second positions together in said pulse position codebook.

3. The method according to claim 1, wherein the analyzing step comprises generating the excitation signal in units of frames.

4. A speech coding method, comprising:

analyzing an input speech signal (1) to divide the input speech signal into a parameter representing a frequency characteristic of speech and an excitation signal, the excitation signal being an input signal to a synthesis filter, the synthesis filter generated based on the parameter, and (2) to output a first index specifying the parameter as a coded result, the excitation signal being formed of a pulse train including pulses selected from first pulses and second pulses, the first pulses being set at first positions located on sampling points of the excitation signal, and the second pulses being set at second positions located between the sampling points of the excitation signal;

generating a synthesized speech signal based on the excitation signal and the coded result;

selecting, from an adaptive codebook, a pitch vector with which a power of an error between the synthesized speech signal and the input speech signal is minimized;

adding the pulse train to the pitch vector to generate the excitation signal; and outputting the first index and a second index indicating the selected pitch vector.

5. The method according to claim 4, further comprising:

making the pulse train periodic in units of pitches.

6. A speech coding method which comprises:

analyzing an input speech signal to divide the input speech signal into a parameter representing a frequency characteristic of a speech and an excitation signal which is an input signal of a synthesis filter generated based on the parameter, to output a first index specifying the parameter as a coded result, the excitation signal being formed of a pulse train including a pulse selected from first pulses and second pulses, the first pulses being set at first positions located on sampling points of the excitation signal and the second pulses being set at second positions located between sampling points of the excitation signal;

generating an excitation signal for exciting a synthesis filter by using a pitch vector and a stochastic vector;

generating the stochastic vector by using a pulse train including a pulse selected from first pulses and second pulses, the first pulses being set on sampling points of the stochastic vector and the second pulses being set between sampling points of the stochastic vector;

generating a synthesized speech signal based on the coded result and the excitation signal; and generating a second index with which an error between the input speech signal and the synthesized speech signal is minimized.

7. A speech coding method which comprises:

analyzing an input speech signal to divide the input speech signal into a parameter representing a frequency characteristic of a speech and an excitation signal which is an input signal of a synthesis filter generated based on the parameter, to output a first index specifying the parameter as a coded result;

generating an excitation signal for exciting a synthesis filter by using a pitch vector and a stochastic vector;

selecting a predetermined number of pulse positions from pulse position candidates to be adapted on the basis of a shape of the pitch vector, the pulse position candidates including first pulse position candidates whose pulse positions are located on sampling points of the stochastic vector and second pulse position candidates whose positions are located between sampling points of the stochastic vector;

arranging pulses at the predetermined number of pulse positions to generate a pulse train to be used for generating the stochastic vector;

generating a synthesized speech signal based the coded result and the excitation signal;

generating a second index indicating a parameter with which an error between the input speech signal and the synthesized speech signal is minimized;

selecting the pulse position candidates from a pulse position codebook in accordance with the second index; and outputting the first and second indexes.

8. A speech decoding method, comprising:

extracting, from a coded stream, a first index indicating a frequency characteristic of a speech, a second index indicating a pulse train of an excitation signal;

reconstructing a synthesis filter by decoding the first index;

reconstructing the excitation signal based on the second index, the pulse train, including pulses selected from first pulses and second pulses, the first pulses being set on sampling points of the excitation signal, and the second pulses being set at positions located between the sampling points of the excitation signal; and generating a decoded speech signal by exciting the synthesis filter using the reconstructed excitation signal.

9. A speech decoding method which comprises:

extracting, from a coded stream, a first index indicting a frequency characteristic of a speech and a second index indicating a pulse train of an excitation signal including a pitch vector and a stochastic vector;

reconstructing a synthesis filter by decoding the first index;

reconstructing the excitation signal based on the second index, the stochastic vector including a pulse selected from first pulses and second pulses, the first pulses being set on sampling points of the excitation signal and the second pulses being set at positions located between sampling points of the excitation signal; and generating a decoded speech signal by exciting the synthesis filter on the basis of the reconstructed excitation signal.

10. A speech decoding method which comprises:

extracting, from a coded stream, a first index indicting a frequency characteristic of a speech and a second index indicating an excitation signal;

reconstructing a synthesis filter by decoding the first index;

reconstructing the excitation signal based on the second index, the excitation signal being constituted by a stochastic vector and a pitch vector, the stochastic vector including a pulse train generated by arranging pulses at a predetermined number of pulse positions selected from pulse position candidates to be adapted on the basis of a shape of the pitch vector, and the pulse position candidates including first pulse position candidates and second pulse position candidates, the first pulse position candidates being set on sampling points of the stochastic vector and the second pulse position candidates being set at positions located between sampling points of the stochastic vector; and decoding a speech signal by exciting a synthesis filter by means of the excitation signal.

11. A speech coding apparatus, comprising:

a speech analyzer section configured to analyze an input speech signal (1) to divide the input speech signal into a parameter representing a frequency characteristic of speech and an excitation signal, the excitation signal being an input signal to a synthesis filter, the synthesis filter generated based on the parameter, and (2) to output a first index specifying the parameter as a coded result;

a pulse excitation section configured to generate a pulse train, as the excitation signal, the pulse train including pulses selected from first pulses and second pulses, the first pulses being set at first positions located on sampling points of the excitation signal, and the second pulses being set at second positions located between the sampling points of the excitation signal;

a speech synthesizer section configured to generate a synthesized speech signal based on the coded result and the excitation signal;

a first index output section configured to generate a second index indicating a parameter with which an error between the input speech signal and the synthesized speech signal is minimized;

a pulse position codebook configured to store pulse position candidates;

a selector section configured to select a pulse position candidate from said pulse position codebook in accordance with the second index; and an output section configured to output the first and second indexes.

12. An apparatus according to claim 11, wherein said pulse position codebook stores the first and second positions together.

13. An apparatus according to claim 11, wherein said pulse excitation section generates the excitation signal in units of frames.

14. A speech coding apparatus, comprising:

a speech analyzer section configured to analyze an input speech signal (1) to divide the input speech signal into a parameter representing a frequency characteristic of speech and an excitation signal, the excitation signal being an input signal to a synthesis filter, the synthesis filter generated based on the parameter, and (2) to output a first index specifying the parameter as a coded result;

a pulse excitation section configured to generate a pulse train, as the excitation signal, the pulse train including pulses selected from first pulses and second pulses, the first pulses being set at first positions located on sampling points of the excitation signal and the second pulses being set at second positions located between the sampling points of the excitation signal;

a speech synthesizer section configured to generate a synthesized speech signal based on the excitation signal and the coded result;

an adaptive codebook configured to store a plurality of pitch vectors;

a selector section configured to select a pitch vector, from an adaptive codebook, with which a power of an error between the synthesized speech signal and the input speech signal is minimized;

an excitation signal generator section configured to add the pulse train to the pitch vector for generating the excitation signal; and an index output section configured to output the first index and a second index indicating the selected pitch vector.

15. The apparatus according to claim 14, further comprising:

a pitch filter configured to make the pulse train periodic in units of pitches.

16. A speech coding apparatus comprising:

a speech analyzer section configured to analyze an input speech signal to divide the input speech signal into a parameter representing a frequency characteristic of a speech and an excitation signal which is an input signal of a synthesis filter generated based on the parameter, to output a first index specifying the parameter as a coded result;

an excitation signal generator section configured to generate the excitation signal including a pitch vector and a stochastic vector, the stochastic vector including a pulse train including a pulse selected from first pulses and second pulses, the first pulses being set at first positions located on sampling points of the excitation signal and the second pulses being set at second positions located between sampling points of the stochastic vector;

a speech synthesizer section configured to generate a synthesized speech signal based on the coded result and the excitation signal; and an index generator section configured to generate a second index with which an error between the input speech signal and the synthesized speech signal is minimized.

17. A speech coding apparatus comprising:

a speech analyzer section configured to analyzing an input speech signal to divide the input speech signal into a parameter representing a frequency characteristic of a speech and an excitation signal which is an input signal of a synthesis filter generated based on the parameter, to output a first index specifying the parameter as a coded result;

an excitation signal generator section configured to generate an excitation signal constituted by a pitch vector and a stochastic vector, the stochastic vector being formed by a pulse train generated by arranging pulses at a predetermined number of pulse positions selected from pulse position candidates to be adapted on the basis of a shape of the pitch vector, and the pulse position candidates including first pulse position candidates and second pulse position candidates, the first pulse position candidates being set on sampling points of the stochastic vector and the second pulse position candidates being set at positions located between the sampling points of the stochastic vector;

a speech synthesizer section configured to generate a synthesized speech signal based on the coded result and the excitation signal;

an index generator section configured to generate a second index indicating a parameter with which an error between the input speech signal and the synthesized speech signal is minimized;

a pulse position codebook configured to store a plurality of pulse position candidates;

a selector section configured to select the pulse position candidate from said pulse position codebook in accordance with the second index.

18. A speech decoding apparatus, comprising:

a demultiplexer section configured to extract, from a coded stream, a first index indicating a frequency characteristic of speech, and a second index indicating a pulse train of an excitation signal;

a reconstruction section configured to reconstruct a synthesis filter by decoding the first index;

an excitation signal reconstructing section configured to reconstruct the excitation signal, including a pulse train that include pulses selected from first pulses and second pulses, the first pulses being set on sampling points of the excitation signal and the second pulses being set at positions located between the sampling points of the excitation signal based on the second index; and a decoding section configured to generate a decoded speech signal by exciting a synthesis filter using the reconstructed excitation signal.

19. A speech decoding apparatus comprising:

a demultiplexer section configured to extract, from a coded stream, a first index indicting a frequency characteristic of a speech and a second index indicating an excitation signal including a pitch vector and a stochastic vector;

a reconstruction section configured to reconstruct a synthesis filter by decoding the first index;

an excitation signal reconstructing section configured to reconstruct the excitation signal based the second index, the excitation signal including a pulse train including a pulse selected from first pulses and second pulses, the first pulses being set on sampling points of the excitation signal and the second pulses being set at positions located between sampling points of the excitation signal; and a decoding section configured to generate a decoded speech signal by exciting the synthesis filter by means of the reconstructed excitation signal.

20. A speech decoding apparatus comprising:

a demultiplexer section configured to extract, from a coded stream, a first index indicting a frequency characteristic of a speech and a second index indicating an excitation signal;

a reconstruction section configured to reconstruct a synthesis filter by decoding the first index;

an excitation signal reconstructing section configured to reconstruct the excitation signal based on the second index, the excitation signal including a pitch vector and a stochastic vector formed of a pulse train generated by arranging pulses at a predetermined number of pulse positions selected from pulse position candidates subjected to adapting on the basis of a shape of the pitch vector, and the pulse position candidates including first pulse position candidates set on sampling points of the stochastic vector and second pulse position candidates set at positions located between the sampling points of the stochastic vector; and a decoding section configured to decode a speech signal by exciting a synthesis filter using the excitation signal.

* * * * *